US007776207B2

(12) United States Patent
Abhari et al.

(10) Patent No.: US 7,776,207 B2
(45) Date of Patent: Aug. 17, 2010

(54) PROCESS TO PRODUCE MIDDLE DISTILLATE

(75) Inventors: Ramin Abhari, Bixby, OK (US); Paul Ahner, Tulsa, OK (US)

(73) Assignee: Syntroleum Corporation, Tulsa, OK (US)

( * ) Notice: Subject to any disclaimer, the term of this patent is extended or adjusted under 35 U.S.C. 154(b) by 218 days.

(21) Appl. No.: 11/868,059

(22) Filed: Oct. 5, 2007

(65) Prior Publication Data

US 2008/0083651 A1 Apr. 10, 2008

Related U.S. Application Data

(60) Provisional application No. 60/828,373, filed on Oct. 5, 2006.

(51) Int. Cl.
*C10G 35/04* (2006.01)
*C10G 69/08* (2006.01)

(52) U.S. Cl. ..... 208/64; 208/63; 208/133; 585/322; 585/323

(58) Field of Classification Search ..... 208/62–64, 208/66, 133, 134, 139, 141; 585/322, 323, 585/319

See application file for complete search history.

(56) References Cited

U.S. PATENT DOCUMENTS

| | | | | |
|---|---|---|---|---|
| 3,631,215 | A * | 12/1971 | Clippinger et al. | 585/419 |
| 5,037,529 | A * | 8/1991 | Dessau et al. | 208/64 |
| 5,227,555 | A * | 7/1993 | Rhoe et al. | 585/322 |
| 6,392,109 | B1 | 5/2002 | O'Rear et al. | |
| 6,875,339 | B2 * | 4/2005 | Rangarajan et al. | 208/62 |
| 7,156,978 | B2 | 1/2007 | Benazzi et al. | |
| 2003/0085153 | A1 * | 5/2003 | O'Rear | 208/63 |
| 2004/0176655 | A1 * | 9/2004 | Ayoub et al. | 585/324 |
| 2006/0106255 | A1 | 5/2006 | Kenneally et al. | |

* cited by examiner

*Primary Examiner*—Walter D Griffin
*Assistant Examiner*—Renee Robinson
(74) *Attorney, Agent, or Firm*—Hall, Estill, Hardwick, et al.

(57) ABSTRACT

A process for producing alkyl aromatic middle distillate fuels is described. The process includes (a) catalytically converting paraffinic naphtha to a composition containing benzene and olefins; (b) processing the olefin/benzene composition in an aromatic alkylation reactor to produce alkyl-benzene components (c) separating the alkyl aromatics from the unconverted naphtha; and (d) optionally recycling the unconverted paraffinic naphtha to the dehydrogenation/amortization reactor of step a.

20 Claims, 1 Drawing Sheet

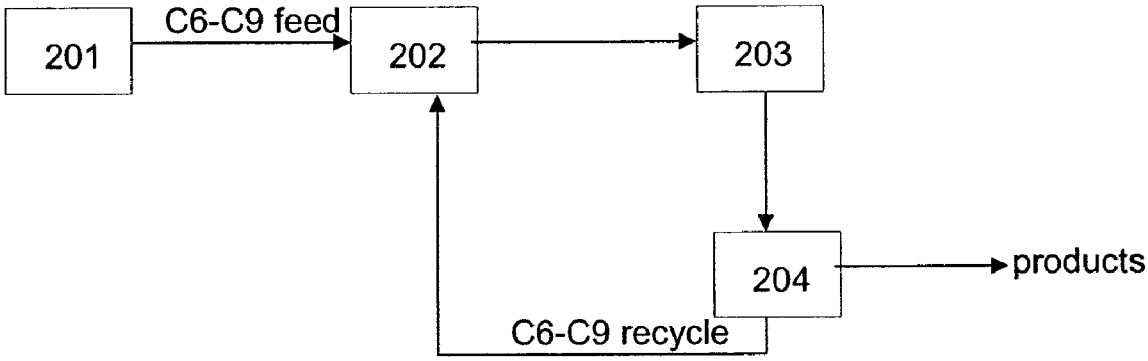
201
C6-C9 feed
202
203
204
products
C6-C9 recycle

PROCESS TO PRODUCE MIDDLE DISTILLATE

CROSS REFERENCE TO RELATED APPLICATIONS

This Application claims priority to U.S. Provisional Application No. 60/828,373, filed on Oct. 5, 2006.

FEDERALLY SPONSORED RESEARCH

Research for the development of the present invention was partially funded by the U.S. Department of Defense-contract no. W56HZV05-6-0435.

REFERENCE TO MICROFICHE APPENDIX

Not applicable.

FIELD OF INVENTION

The invention relates to a process for the production of middle distillates from synthetic naphtha.

BACKGROUND OF THE INVENTION

Iso-paraffinic synthetic fuels (or "synfuels" for short) generally lack one or more desirable fuel attributes. For gasoline, this includes low octane values. In the case of jet fuel, these include lower density and lack of seal-swelling properties. Lack of seal-swelling properties means that a fuel tank equipped with nitrile rubber closure gasket used for conventional petroleum fuels ("petro-fuels") will leak if filled with an iso-paraffinic synfuel. These differences with petro-fuels can limit use of iso-paraffinic synfuels. One solution has been to blend these synfuels with petro-fuels. However, blending with petro-fuels generally downgrades the synfuel's low emission qualities. Particulate emissions are attributed to naphthalene-type molecules in crude oil.

Since aromatic hydrocarbons have higher density and can impart seal swelling properties, alkyl benzenes of jet fuel boiling range may be used as blend stocks for corresponding iso-paraffinic synfuels to solve the seal-swell and density issues without affecting their desirable low particulate emission qualities. In the case of gasoline, the alkyl-benzenes are known to increase synfuel octane value.

Synthesis of alkyl aromatics via olefins and benzene has industrially important applications, such as manufacture of cumene and detergent-range linear alkyl benzenes. Alkyl benzenes having alkyl groups with from about 4 to about 9 carbon atoms may also be used as chemical intermediates or as fuel blend stocks.

Traditional processes for manufacturing alkyl aromatic components employ different catalysts and reactors for the benzene and olefin components used to make the alkyl benzene products. For example catalytic reforming may be used to convert paraffinic feedstock to benzene by dehydrocyclization. Olefin production is typically achieved by dehydrogenation of the paraffins. Thus, the combination of two processes to make these components is capital-intensive.

Consequently, a simpler process for the preparation of alkyl benzenes and synthetic fuels would be useful.

SUMMARY OF THE INVENTION

A process for producing one or more middle distillate fuels is described. An embodiment of the described process includes (a) dehydrogenating/aromatizing a paraffinic naphtha stream into a composition containing olefins and aromatic hydrocarbons (b) subjecting the olefins and aromatic components to aromatic alkylation, and (c) separating the alkyl aromatics of middle distillate range.

In some embodiments the synthetic naphtha is a product of the Fischer-Tropsch process. Selected Fischer-Tropsch processes employ synthesis gas derived from coal, petroleum coke, natural gas, petroleum residue and biomass. In other embodiments, the synthetic naphtha may be the co-product of hydroprocessing glycerides (mono-, di-, and tri-), and fatty acids present in vegetable oils, animal fats, and restaurant greases.

Embodiments of the invention also include products produced by one or more of the methods described herein, particularly wherein the products include chemical intermediates, gasoline, kerosene, jet fuel and diesel fuel. Products further comprising petroleum- or bio-based fuels in any desirable amount are also contemplated.

BRIEF DESCRIPTION OF THE DRAWING

FIG. 1 depicts a process for selectively converting paraffinic components according to one embodiment of the invention.

DETAILED DESCRIPTION OF THE INVENTION

The terms "middle distillate product(s)" and "middle distillate" refer to hydrocarbon mixtures with a boiling point range that corresponds substantially with that of kerosene and gas oil fractions obtained in a conventional atmospheric distillation of crude oil material. The middle distillate boiling point range may include temperatures between about 150° C. and about 600° C., with a fraction boiling point between about 200° C. and about 360° C.

The term "middle distillate fuel" means jet fuel, kerosene, diesel fuel, gasoline, and combinations thereof.

The term "BTX" means Benzene, Toluene, Xylene, or a mixture of any of Benzene, Toluene, and Xylene.

The term "$C_x$", where x is a number greater than zero, refers to a hydrocarbon compound having predominantly a carbon number of x. As used herein, the term $C_x$ may be modified by reference to a particular species of hydrocarbons, such as, for example, $C_5$ olefins. In such instance, the term means an olefin stream comprised predominantly of pentenes but which may have impurity amounts, i.e. less than about 10%, of olefins having other carbon numbers such as hexene, heptene, propene, or butene.

The term "light fraction" generally indicates a hydrocarbon comprised primarily of $C_2$ to $C_{24}$ hydrocarbons; preferably $C_2$-$C_9$ in some cases.

The term "heavy fraction" generally indicates a hydrocarbon comprised primarily of hydrocarbons having a carbon number greater than about $C_{24}$, but in some cases the heavy fraction contains $C_1$+fractions.

Naphtha fractions described herein generally have a boiling range of 30 to 250 degrees F. and contains alkanes in the $C_5$ to $C_9$ range.

LPG fractions generally refer to hydrocarbons having from 2 to 5 carbon atoms, but in most cases 3 and 4.

It has surprisingly been found that using certain noble metal catalyst systems naphtha range paraffins that do not cyclize to an aromatic will dehydrogenate to form olefins which will react in the alkylation step to form alkylated aromatics in the middle distillate boiling range. In particular, commercially available tin/platinum-on-alumina catalysts convert n-hexane to benzene and convert $C_7$ paraffins to linear internal olefins with high selectivity. Thus, the conversion of naptha-range n-paraffin feed to a composition suitable for aromatic alkylation.

One such process is schematically represented in FIG. 1. In FIG. 1, an n-paraffin naphtha feed 201 is provided to a dehydrogenation unit 202 equipped with a tin/platinum-on-alumina catalyst. The product of the dehydrogenation unit 202 is fed to aromatic alkylation unit 203. Homogeneous Lewis acid catalysts such as aluminum trichloride or boron trifluoride, and heterogeneous zeolite catalysts, may be employed to carryout the aromatic alkylation reaction. Alkylated-benzenes and unconverted $C_6$-$C_9$ products are provided to a separator 204 configured to separate $C_{10}$+ products from lower carbon products, including the unconverted $C_6$-$C_9$ fraction. Conventional distillation is well suited for this application. The separated unconverted fraction may be recycled to the dehydrogenation unit 202.

When the paraffinic naphtha is the byproduct of a middle distillate synfuel process, this method can be employed to maximize $C_{10}$+ product yield and modify the product properties such as density and seal swell.

EXAMPLE 1

Commercial Sn/Pt-on-alumina dehydrogenation catalyst from Englehard Corporation comprising 0.65-0.85 wt. percent Sn, 0.40-0.58 wt. percent Li, 0.30-0.45 wt. percent Pt is used. The catalyst has a particle size of 1.58-2.54 mm and a surface area of 140-180 $m^2/g$ according to BET-$N_2$ surface area measurements. Tube-in-tube glassware is used in a reactor with about 0.1 g of catalyst in the inside tube. Slits in the bottom tube allow for bottom-up feed flow. The reactor is placed in a furnace and heated to about 450° C. under a flow of hydrogen suitable for catalyst activation. After 30 minutes of activation, hydrocarbon recirculation is started. Results from n-hexane, n-heptane, and n-octane are presented in Tables I-III respectively.

TABLE I

| Reactor Conditions | | | |
|---|---|---|---|
| Catalyst | 0.1171 g | | |
| Reactor temp | 450° C. | | |
| n-$C_6$ | 10 torr | | |
| $H_2$ | 200 torr | | |
| He | 790 torr | | |
| | Batch Cycle Time (min) | | |
| Products (wt. percent) | 10 min | 30 min | 50 min |
| Ethane/Ethylene | 0.883 | 1.397 | 1.561 |
| Propane/propylene | 0.785 | 1.271 | 1.437 |
| 1-butene | 0.28 | 0.398 | 0.252 |
| 1-hexene | 1.247 | 0.522 | 1.736 |
| n-hexane | 44.448 | 15.307 | 5.9 |
| trans-2-hexene | 2.197 | 0.88 | 2.695 |
| cis-2-hexene | 1.225 | 0.495 | 2.216 |
| Benzene | 38.542 | 69.323 | 80.66 |

TABLE II

| Reactor Conditions | | | |
|---|---|---|---|
| Catalyst | 0.1147 g | | |
| Reactor temp | 450° C. | | |
| n-$C_7$ | 10 torr | | |

TABLE II-continued

| Reactor Conditions | | | |
|---|---|---|---|
| $H_2$ | 200 torr | | |
| He | 790 torr | | |
| | Batch Cycle Time (min) | | |
| Products (wt. percent) | 10 min | 30 min | 50 min |
| 1-heptene | 1.2066 | 1.215 | 1.187 |
| trans-3-heptene | 4.552 | 4.523 | 4.561 |
| n-heptane | 83.844 | 79.715 | 76.456 |
| trans-2-heptene | 4.159 | 4.165 | 4.123 |
| cis-2-heptene | 2.252 | 2.28 | 2.26 |
| Toluene | 0.24 | 0.247 | 0.257 |
| Total n-heptenes | 12.1696 | 12.183 | 12.131 |

TABLE III

| Reactor Conditions | | |
|---|---|---|
| Catalyst | 0.1192 g | |
| Reactor temp | 450° C. | |
| n-$C_8$ | 10 torr | |
| $H_2$ | 200 torr | |
| He | 790 torr | |
| | Batch Cycle Time (min) | |
| Products (wt. percent) | 30 min | 50 min |
| n-butane | 0.737 | 1.147 |
| 2-methyl-1,3-butadiene | 0.771 | 1.216 |
| 1-octene | 1.568 | 1.855 |
| trans-3-octene | 2.461 | 2.273 |
| cis-3-heptene | 5.127 | 5.404 |
| 1,2,3 trimethylcyclopentane | 1.568 | 1.653 |
| n-octane | 71.468 | 71.237 |
| trans-2-octene | 3.516 | 3.683 |
| cis-2-heptene | 2.004 | 2.121 |
| Ethylbenzenes | 1.44 | 1.814 |
| Total n-octenes | 14.676 | 15.336 |

Variations, modifications and additions to this invention will be readily apparent to one skilled in the art and such modifications and additions would be fully within the scope of the invention, which is not limited by the claims.

We claim:

1. A process for producing at least one middle distillate from a paraffinic naphtha containing n-hexane, n-heptane and/or n-octane comprising:

(a) catalytically converting the paraffinic naphtha to a hydrocarbon composition containing benzene and at least one olefin, wherein the n-hexane is selectively converted to benzene and wherein the n-heptane and/or n-octane are selectively converted to at least one olefin;

(b) alkylating the hydrocarbon composition of step (a) to produce at least one alkyl benzene component; and (c) separating the at least one alkyl benzene component from unconverted paraffinic naphtha.

2. The process of claim 1 further comprising the step of: recycling the unconverted paraffinic naphtha to step (a).

3. The process of claim 1 wherein the step (a) catalyst is tin/platinum on alumina.

4. The process of claim 1 wherein the step (b) reaction is catalyzed by a Lewis acid.

5. The process of claim 4 wherein the Lewis acid is aluminum trichloride.

6. The process of claim 4 wherein the Lewis acid is boron trifluoride.

7. The process of claim 1 wherein the step (b) reaction is catalyzed by at least one zeolite.

8. The process of claim 1 wherein the paraffinic naphtha is a co-product of Fischer-Tropsch synthesis.

9. The process of claim 1 wherein the at least one alkyl benzene component has an improved seal swell as compared to paraffinic middle distillates.

10. The process of claim 1 wherein the at least one alkyl benzene component has a higher density than paraffinic middle distillates.

11. The process of claim 1 wherein the at least one alkyl benzene component is blended with at least one synthetic paraffinic middle distillate to produce a synthetic fuel having alkyl benzene and paraffin functionalities.

12. The process of claim 11 wherein the synthetic fuel is diesel.

13. The process of claim 11 wherein the synthetic fuel is jet fuel.

14. The process of claim 1 wherein a fraction of the at least one alkyl benzene component is used as a motor gasoline blend stock.

15. A process for producing one or more middle distillates, comprising the steps of:

dehydrogenating a paraffinic naphtha into a composition consisting essentially of at least one olefin and benzene, wherein n-hexane is selectively converted to benzene;

subjecting the at least one olefin and the benzene to aromatic alkylation to form at least one alkyl benzene component; and separating the at least one alkyl aromatic benzene component of a middle distillate range from unconverted paraffinic naphtha.

16. The process of claim 15 further comprising the step of:

recycling the unconverted paraffinic naphtha to the step of dehydrogenating.

17. The process of claim 15 wherein the paraffinic naphtha is dehydrogenated using a tin/platinum on alumina catalyst.

18. The process of claim 15 wherein the composition having at least one olefin and at least one hydrocarbon is catalyzed by a Lewis acid.

19. The process of claim 15 wherein the paraffinic naphtha is a co-product of Fischer-Tropsch synthesis.

20. The process of claim 15 wherein the alkyl benzene component is blended with at least one synthetic paraffinic middle distillate to produce a synthetic fuel having alkyl benzene and paraffin functionalities.

* * * * *